US011391295B2

(12) United States Patent
Sawada et al.

(10) Patent No.: US 11,391,295 B2
(45) Date of Patent: Jul. 19, 2022

(54) PROPELLER FAN

(71) Applicant: FUJITSU GENERAL LIMITED, Kanagawa (JP)

(72) Inventors: Hirotaka Sawada, Kanagawa (JP); Kazuya Funada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 234 days.

(21) Appl. No.: 15/911,649

(22) Filed: Mar. 5, 2018

(65) Prior Publication Data

US 2018/0335045 A1 Nov. 22, 2018

(30) Foreign Application Priority Data

May 22, 2017 (JP) ..... JP2017-101028
May 22, 2017 (JP) ..... JP2017-101029

(51) Int. Cl.
*F04D 29/32* (2006.01)
*F04D 29/38* (2006.01)
*F04D 29/66* (2006.01)

(52) U.S. Cl.
CPC ..... *F04D 29/325* (2013.01); *F04D 29/38* (2013.01); *F04D 29/384* (2013.01);
(Continued)

(58) Field of Classification Search
CPC ..... F04D 29/384; F04D 29/325; F04D 29/38; F04D 29/388; F04D 29/661; F05B 2240/30
(Continued)

(56) References Cited

U.S. PATENT DOCUMENTS 7,014,425 B2 * 3/2006 Havel ..... F04D 29/384 416/169 A
8,100,665 B2 * 1/2012 De Filippis ..... F04D 29/384 416/238
(Continued)

FOREIGN PATENT DOCUMENTS

CN 101387304 A 3/2009
CN 105275501 A 1/2016
(Continued)

OTHER PUBLICATIONS

Sep. 17, 2018, European Search Report issued for related EP application No. 18160576.7.
(Continued)

*Primary Examiner* — Richard A Edgar
(74) *Attorney, Agent, or Firm* — Paratus Law Group, PLLC

(57) ABSTRACT

A propeller fan includes: a hub having a side surface about a center axis; and a plurality of blades provided on the side surface of the hub. Each blade includes an inner peripheral portion positioned closer to a base portion of the each blade connected to the hub, and an outer peripheral portion positioned closer to an outer edge of the each blade. A ratio r/R between a radius r as a distance from the center axis to a boundary between the inner peripheral portion and the outer peripheral portion and a radius R as a distance from the center axis to the outer edge of each blade is equal to or lower than 0.4. A relational expression of $V1<V2\times1.3$ is satisfied, where an air velocity at the outer peripheral portion is V1 and an air velocity at the inner peripheral portion is V2.

3 Claims, 8 Drawing Sheets

(52) U.S. Cl.
CPC ..... *F04D 29/388* (2013.01); *F04D 29/661* (2013.01); *F05B 2240/30* (2013.01)

(58) Field of Classification Search
USPC ..... 416/227 R, 231 R, 231 B
See application file for complete search history.

(56) References Cited

U.S. PATENT DOCUMENTS

| | | | |
|---|---|---|---|
| 2005/0129518 | A1 | 6/2005 | Havel et al. |
| 2006/0201721 | A1 | 9/2006 | Fukuyama |
| 2009/0151911 | A1 | 6/2009 | De Filippis et al. |

FOREIGN PATENT DOCUMENTS

| | | | |
|---|---|---|---|
| JP | H02-101098 | U | 8/1990 |
| JP | 2003-503643 | A | 1/2003 |
| JP | 2004-116511 | A | 4/2004 |
| JP | 2010-101223 | A | 5/2010 |
| JP | 2013-217314 | A | 10/2013 |
| JP | 2015-034503 | A | 2/2015 |
| WO | WO 2011/001890 | A1 | 1/2011 |

OTHER PUBLICATIONS

Oct. 26, 2020, Chinese Office Action issued for related CN Application No. 201810188062.8.
Feb. 24, 2021, Japanese Office Action issued for related JP Application No. 2017-101028.
Feb. 24, 2021, Japanese Office Action issued for related JP Application No. 2017-101029.

* cited by examiner

PROPELLER FAN

CROSS-REFERENCE

This application claims priority from Japanese Patent Application No. 2017-101028 and Japanese Patent Application No. 2017-101029 filed with the Japan Patent Office on May 22, 2017, the entire content of which is hereby incorporated by reference.

FIELD

The present disclosure relates to a propeller fan.

BACKGROUND ART

For example, an air conditioner has, in an outdoor unit thereof, a propeller fan. An air velocity at the propeller fan is faster at a blade outer peripheral portion, and decreases toward the center of rotation. In recent years, the volume of air from the propeller fan has been improved for improvement of energy saving performance of the air conditioner. Specifically, the size of the propeller fan has been increased, and the speed of rotation of the propeller fan has been increased, for example.

Note that the technique of this area is disclosed in Japanese Laid-open Patent Publication No. 2010-101223, PCT International Application Publication No. WO 2011/001890 A. Japanese Translation of PCT International Application Publication No. JP-T-2003-503643, and Japanese Laid-open Patent Publication No. 2004-116511, for example.

SUMMARY

A propeller fan includes: a hub having a side surface about a center axis; and a plurality of blades provided on the side surface of the hub. Each blade includes an inner peripheral portion positioned closer to a base portion of the each blade connected to the hub, and an outer peripheral portion positioned closer to an outer edge of the each blade. A ratio r/R between a radius r as a distance from the center axis to a boundary between the inner peripheral portion and the outer peripheral portion and a radius R as a distance from the center axis to the outer edge of each blade is equal to or lower than 0.4. A relational expression of $V1<V2\times1.3$ is satisfied, where an air velocity at the outer peripheral portion is V1 and an air velocity at the inner peripheral portion is V2.

DETAILED DESCRIPTION OF THE INVENTION

Figure 1:
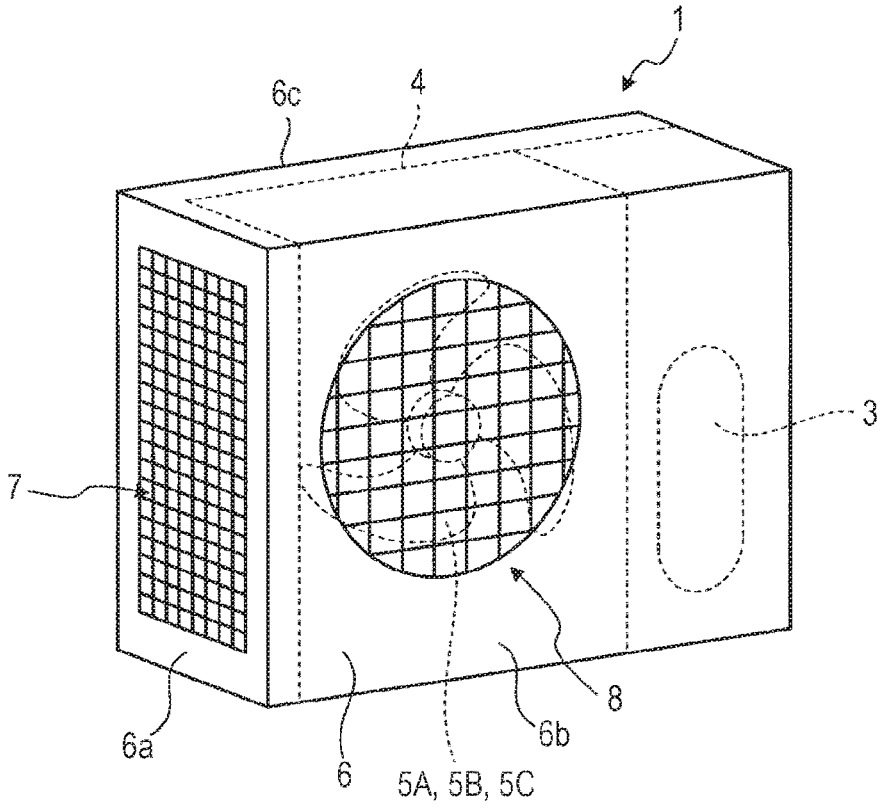
FIG. 1 is a schematic view of an outdoor unit having a propeller fan according to a first embodiment (second and third embodiments)

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In a typical technique, air velocity distribution in a radial direction at a blade is non-uniform. For this reason, a surging phenomenon such as suction of air from a downstream side occurs at an inner peripheral portion of the blade, leading to an abnormal operation state. In the case of using a propeller fan for an outdoor unit, there is probability that the surging phenomenon leads to noise and damage of the propeller fan. Moreover, each inner peripheral portion of the propeller fan with a lower air velocity does not much contribute to air blowing. For this reason, it can be said that the amount of blown air with respect to the size of the propeller fan is smaller and each blade surface is not effectively used.

An object of the present disclosure is to provide a propeller fan and an outdoor unit of an air conditioner which are configured so that a difference (an air velocity difference) between an air velocity at an outer peripheral portion and an air velocity at an inner peripheral portion in a blade can be reduced and the volume of air from the propeller fan can be improved.

A propeller fan according to one aspect of the present disclosure includes: a hub having a side surface about a center axis; and a plurality of blades provided on the side surface of the hub. Each blade includes an inner peripheral portion positioned closer to a base portion of the each blade connected to the hub, and an outer peripheral portion positioned closer to an outer edge of the each blade. A ratio r/R between a radius r as a distance from the center axis to a boundary between the inner peripheral portion and the outer peripheral portion and a radius R as a distance from the center axis to the outer edge of each blade is equal to or lower than 0.4. A relational expression of $V1<V2\times1.3$ is satisfied, where an air velocity at the outer peripheral portion is V1 and an air velocity at the inner peripheral portion is V2.

According to one aspect of the present disclosure, the difference between the air velocity at the blade outer peripheral portion and the air velocity at the blade inner peripheral portion (a blade center portion) can be reduced while the volume of air from the propeller fan can be improved.

Embodiments of the present disclosure will be described in detail below with reference to the drawings. Various embodiments described below are not intended to limit the technique of the present disclosure. Moreover, various embodiments described below may be, as necessary, implemented in combination within a consistent range. Note that description of already-described elements is not repeated.

First Embodiment (Configuration of Outdoor Unit)

FIG. 1 is a schematic view of an outdoor unit having a propeller fan according to a first embodiment. As illustrated in FIG. 1, an outdoor unit 1 of the first embodiment is an outdoor unit of an air conditioner. The outdoor unit 1 has a housing 6. The housing 6 houses therein a compressor 3 configured to compress refrigerant, a heat exchanger 4 coupled to the compressor 3 and configured such that the refrigerant flows, and a propeller fan 5A configured to send air to the heat exchanger 4.

The housing 6 has suction openings 7 for taking in ambient air, and a blowing opening 8 for discharging air from the housing 6. The suction openings 7 are each provided at a side surface 6*a* and a back surface 6*c* of the housing 6. The blowing opening 8 is provided at a front surface 6*b* of the housing 6. The heat exchanger 4 is disposed across the side surface 6*a* and the back surface 6*c* facing the front surface 6*b* of the housing 6. The propeller fan 5A is disposed facing the blowing opening 8, and is rotatably driven by a fan motor (not shown). In description below, a side in the direction of air discharged from the blowing opening 8 by rotation of the propeller fan 5A is a positive pressure side, and the opposite side thereof is a negative pressure side.

(Propeller Fan of First Embodiment)

Figure 2:
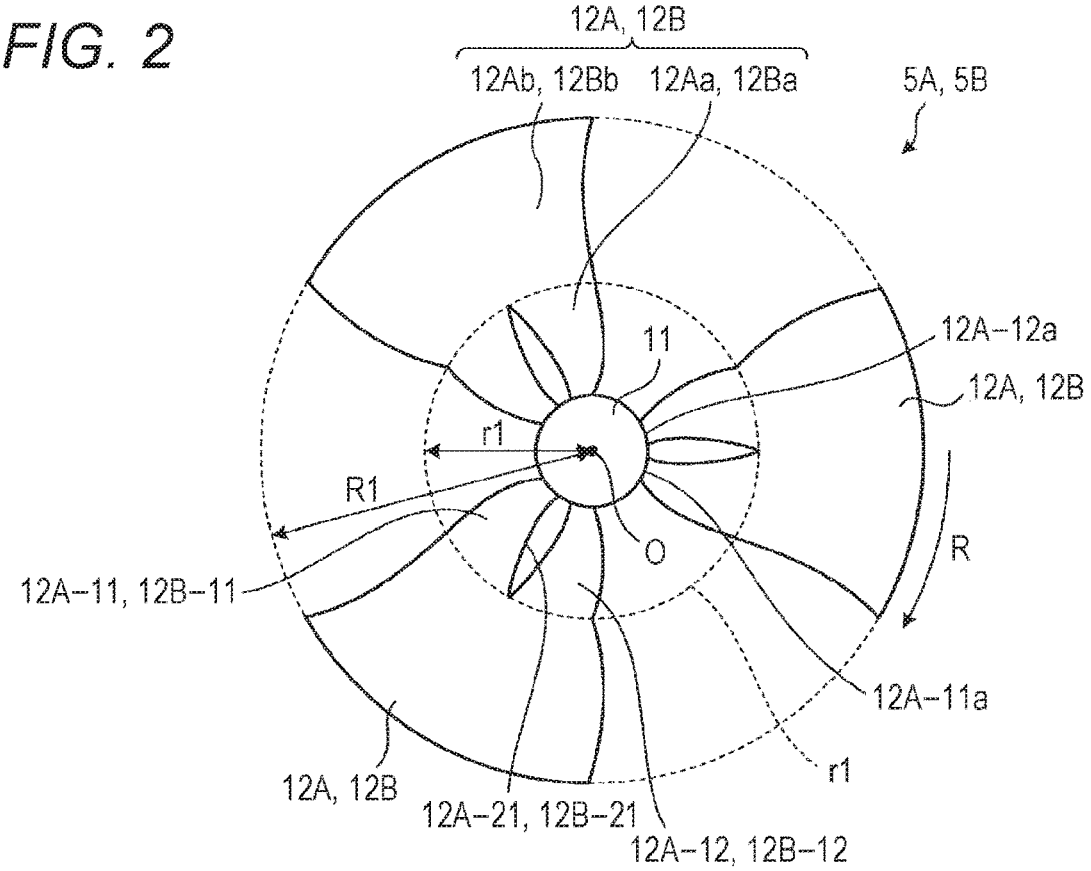
FIG. 2 is a schematic plan view of a fan according to the first embodiment (the second embodiment) as viewed from a positive pressure side.

FIG. 2 is a schematic plan view of the propeller fan according to the first embodiment as viewed from the positive pressure side. As illustrated in FIG. 2, the propeller fan 5A according to the first embodiment has a hub 11 with a circular columnar (or polygonal columnar) outer appearance, and a plurality of blades 12A. The plurality of blades 12A are provided on a side surface 11*a* provided about the center axis of the hub 11. The hub 11 and the plurality of blades 12A are integrally molded using a molding material such as a resin material. The blade will be also called a vane. The hub 11 is formed in a circular columnar shape. The hub 11 has, at a position on the center axis O, a boss (not shown) onto which a shaft (not shown) of the fan motor is fitted. The hub 11 rotates, in association with rotation of the fan motor, about the center axis O of the hub 11 as viewed in plane in the direction of "R" illustrated in the figure. The boss (not shown) is provided on the negative pressure side (see FIG. 3). The plurality of (three in an example of FIG. 2) blades 12A are formed integrally with the hub 11 at predetermined intervals along a circumferential direction of the hub 11 on the side surface 11*a* of the hub 11. Each blade 12A is formed in a plate shape.

In FIG. 2, the propeller fan 5A has, as viewed in plane, inner peripheral portions 12Aa and outer peripheral portions 12Ab of the blades 12A. The inner peripheral portions 12Aa are positioned within the circumference of a circle with a radius r1 about the center axis O. The outer peripheral portions 12Ab are positioned outside the circumference of the circle with the radius r1 about the center axis O and within the circumference of a circle with a radius R1 about the center axis O. As illustrated in FIG. 2, the outer peripheral portion 12Ab extending in a radial direction of the hub 11 is formed with a blade area larger than that of the inner peripheral portion 12Aa coupled to the hub 11. A ratio r1/R1 (hereinafter referred to as a "radius ratio") between the radius r1 and the radius R1 as described herein satisfies Expression (1) below.

$$r1/R1 \leq 0.4 \quad (1)$$

For example, a radius ratio r1/R1 of 0.4 means that a boundary between the inner peripheral portion 12Aa and the outer peripheral portion 12Ab of the blade 12A as defined by the radius r1 from the center axis O is at a position with a length from the center axis O, the length being 0.4 times as long as the radius R1. Note that in the present embodiment, r1=88 [mm] (ϕ=176) and R1=220 [mm] (ϕ=440) are satisfied by way of example.

Moreover, in FIG. 2, the propeller fan 5A has, in each inner peripheral portion 12Aa of the blades 12A, blade elements 12A-11, 12A-12 as viewed in plane. Further, in FIG. 2, the propeller fan 5A has, as viewed in plane, a hole 12A-21 between the blade element 12A-11 and the blade element 12A-12 in each inner peripheral portion 12Aa of the blades 12A. The hole 12A-21 is provided in abutting contact with the boundary (the position with the radius r1 from the center axis O) between the inner peripheral portion 12Aa and the outer peripheral portion 12Ab. That is, each blade 12A is connected to the hub 11 such that a base portion 12A-11*a* of the blade element 12A-11 and a base portion 12A-12*a* of the blade element 12A-12 form the hole 12A-21 in the inner peripheral portion 12Aa. Each outer peripheral portion 12Ab is formed continuously from the blade element 12A-11 and the blade element 12A-12. The inner peripheral portion 12Aa and the outer peripheral portion 12Ab form a single blade surface. In the present embodiment, the base portion 12A-11*a* and the base portion 12A-12*a* are a base portion described in the CLAIMS. That is, the base portion 12A-11*a* and the base portion 12A-12*a* are portions of the blade 12A, the portions being connected to the hub 11.

In other words, the two blade elements 12A-11, 12A-12 are formed in such a manner that the blade 12A is branched from the outer peripheral portion 12Ab of the blade 12A while extending toward the inner peripheral portion 12Aa of the blade 12A. The hole 12A-21 between the blade element 12A-11 and the blade element 12A-12 serves as a flow passage of an air current passing through the propeller fan 5A.

Figure 3:
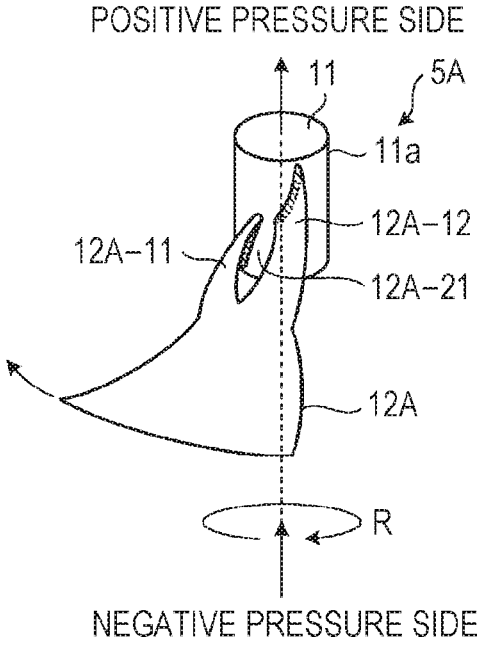
FIG. 3 is a schematic perspective view of the propeller fan according to the first embodiment.

FIG. 3 is a schematic perspective view of the propeller fan according to the first embodiment. FIG. 3 is a schematic enlarged perspective view of one of the plurality of blades 12A illustrated in FIG. 2. As illustrated in FIG. 3, the blade element 12A-12 positioned on an upstream side (a back edge side) in a rotation direction (the direction of "R" in the figure) is, in each blade 12A, connected to the hub 11 on the positive pressure side with respect to the blade element 12A-11 positioned on a downstream side (a front edge side). Moreover, the hole 12A-21 of each blade 12A is positioned between the blade element 12A-12 and the blade element 12A-11 in a center axis O direction and the circumferential direction.

In a case where a maximum air velocity at the outer peripheral portion 12Ab upon rotation of the propeller fan 5A is V1 [m/s] and a maximum air velocity at the inner peripheral portion 12Aa upon rotation of the propeller fan 5A is V2 [m/s], Expression (2) below is satisfied.

$$V1<V2\times1.3 \quad (2)$$

In other words, an air velocity ratio V1/V2 as the ratio of the air velocity V1 at the outer peripheral portion 12Ab to the air velocity V2 at the inner peripheral portion 12Aa satisfies Expression (3) below. Expression (3) is obtained by deformation of Expression (2).

$$V1/V2<1.3 \quad (3)$$

Note that the number of blade elements 12A-11, 12A-12 and the number of holes 12A-21 in the blade 12A of the first embodiment are not limited to those illustrated in FIGS. 2 and 3. The blade 12A may have three or more blade elements and two or more holes. That is, the outer peripheral portion 12Ab may be formed (configured) as a single blade surface (e.g., a blade surface with no hole), and the inner peripheral portion 12Aa may include plurality of blade elements disposed at predetermined intervals.

Second Embodiment (Propeller Fan of Second Embodiment)

Figure 4:
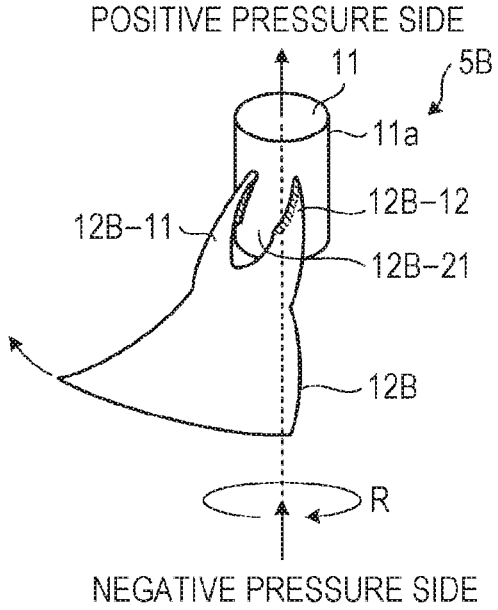
FIG. 4 is a schematic perspective view of the propeller fan according to the second embodiment.

FIG. 4 is a schematic perspective view of a propeller fan according to a second embodiment. A propeller fan 5B according to the second embodiment is housed in an outdoor unit 1 illustrated in FIG. 1 as in the propeller fan 5A according to the first embodiment. Moreover, a schematic plan view of the propeller fan 5B as viewed from the positive pressure side is similar to the equivalent plan view of the propeller fan 5A according to the first embodiment illustrated in FIG. 2. Thus, in FIG. 2, each reference numeral of the propeller fan 5B and components according to the second embodiment is described in parentheses.

FIG. 4 is a schematic enlarged perspective view of one of a plurality of blades 12B illustrated in FIG. 2. As illustrated in FIG. 4, each blade 12B has an inner peripheral portion 12Ba, an outer peripheral portion 12Bb, a blade element 12B-11, a blade element 12B-12, a base portion 12B-11*a*, a base portion 12B-12*a*, and a hole 12B-21 similar to the inner peripheral portion 12Aa, the outer peripheral portion 12Ab, the blade element 12A-11, the blade element 12A-12, the base portion 12A-11*a*, the base portion 12A-12*a*, and the hole 12A-21 of the blade 12A. Note that in the blade 12B, the blade element 12B-12 positioned on an upstream side in a rotation direction (the direction of "R" in the figure) and the blade element 12B-11 positioned on a downstream side are connected to the same height position of a hub 11 in a center axis O direction.

As in the blade 12A according to the first embodiment, the blade 12B according to the second embodiment also satisfies Expressions (1) to (3) as described above.

Note that the number of blade elements 12B-11, 12B-12 and the number of the holes 12B-21 in the blade 12B according to the second embodiment are not limited to those illustrated in FIGS. 2 and 4. The blade 12B may have three or more blade elements and two or more holes. That is, the outer peripheral portion 12Bb may be formed (configured) as a single blade surface (e.g., a blade surface with no hole), and the inner peripheral portion 12Ba may include a plurality of blade elements disposed at predetermined intervals.

(Relationship Between Air Volume and Static Pressure and Relationship Between Radius Ratio and Air Velocity Ratio)

Figure 5:
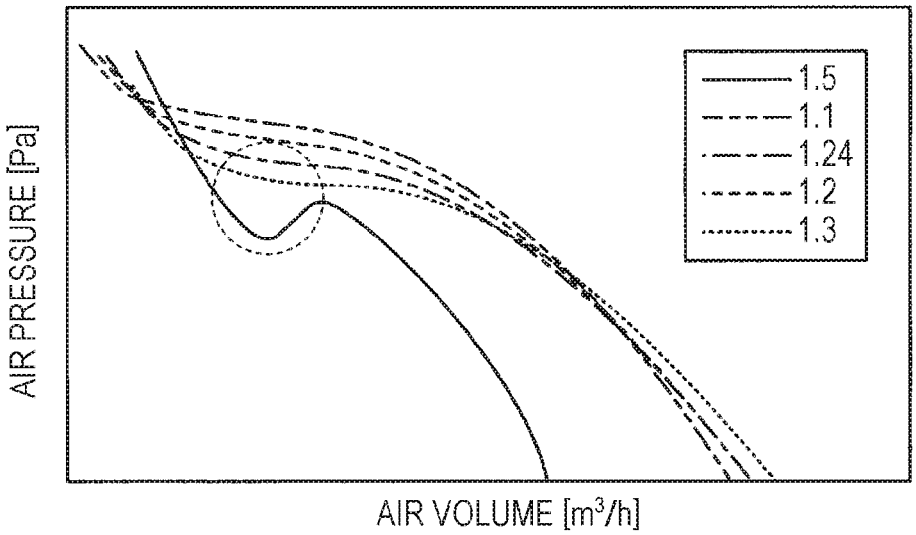
FIG. 5 illustrates P-Q curves.

FIG. 5 illustrates P-Q curves. FIG. 5 illustrates the basis of a radius ratio of equal to or lower than 0.4 and an air velocity ratio V1/V2 of equal to or lower than 1.3 in the propeller fans of the first and second embodiments. In FIG. 5, an air volume Q [$m^3$/h] is the horizontal axis, and an air pressure P [Pa] is the vertical axis.

FIG. 5 illustrates the P-Q curves in the case of air velocity ratios V1/V2 of 1.1, 1.2, 1.24, 1.3, and 1.5. In FIG. 5, the P-Q curve in the case of an air velocity ratio V1/V2 of 1.5 corresponds to a typical propeller fan having no blade element in each inner peripheral portion. The P-Q curves in the case of air velocity ratios V1/V2 of 1.1, 1.2, 1.24, and 1.3 correspond to the propeller fan 5A (5B) having the plurality of blade elements 12A-11, 12A-12 (12B-11 and 12B-12) in each inner peripheral portion 12Aa (12Ba). In the propeller fan corresponding to each type of data, the chord length (the length of a straight line connecting one end and the other end of the blade element in a longitudinal direction of a section) of each of the blade elements 12A-11, 12A-12 (12B-11 and 12B-12) is adjusted such that the air velocity ratio V1/V2 reaches the above-described numerical value. The propeller fan with an air velocity ratio V1/V2 of 1.5 exhibits P-Q curve properties with a local minimum value and a local maximum value of a cubic curve. This means occurrence of a surging phenomenon (see a portion surrounded by a dashed circle in FIG. 5).

The surging phenomenon described herein occurs when a blowing capacity at the inner peripheral portion 12Aa reaches lower than that of the outer peripheral portion 12Ab and a difference (an air velocity difference) between an air velocity at the inner peripheral portion 12Aa and an air velocity at the outer peripheral portion 12Ab increases in the blade 12A. The surging phenomenon occurs within such a flow rate range that the P-Q properties of the propeller fan show the local minimum value and the local maximum value of the cubic curve. The surging phenomenon is a phenomenon that the pressure and flow rate of air become instable and greatly change within the above-described flow rate range. When the propeller fan is operated within the flowrate range leading to such a phenomenon, vibration and/or a backflow occur. As a result, it is, due to occurrence of noise and/or pressure pulsation, difficult to perform normal operation.

On the other hand, in the case of the air velocity ratio V1/V2≤1.3, a lower air velocity ratio V1/V2 results in a gentler P-Q curve. Thus, the surging phenomenon does not occur, and the air volume can be improved.

From the above, it has been found that a surging region is caused depending on a blade shape in the case of an air velocity ratio V1/V2 of equal to or higher than 1.3. On the other hand, it has been found that occurrence of the surging region can be reduced regardless of the blade shape in the case of an air velocity ratio V1/V2 of lower than 1.3.

Note that in a relationship between the air volume [$m^3$/h] and an input [W], input power (power applied to a not-shown fan motor for driving the propeller fan) for outputting the same air volume is smaller in the propeller fans according to the first and second embodiments with air velocity ratios V1/V2 of 1.1, 1.2, 1.24, and 1.3 as compared to the typical propeller fan with an air velocity ratio V1/V2 of 1.5. Moreover, in the case of the same input power, a higher air velocity ratio V1/V2 results in a greater air volume. In a relationship between the air volume [$m^3$/h] and the number of rotations [rpm], the number of rotations for the same air volume is smaller in the propeller fans according to the first and second embodiments with air velocity ratios V1/V2 of 1.1, 1.2, 1.24, and 1.3 as compared to the propeller fan with an air velocity ratio V1/V2 of 1.5. Moreover, a higher air velocity ratio V1/V2 results in a greater air volume.

As described above, as long as the propeller fans 5A, 5B satisfy two conditions of the radius ratio r1/R1≤0.4 and V1<V2×1.3 (or V1/V2<1.3) in the first and second embodiments, occurrence of surging can be reduced.

Third Embodiment

Figure 6:
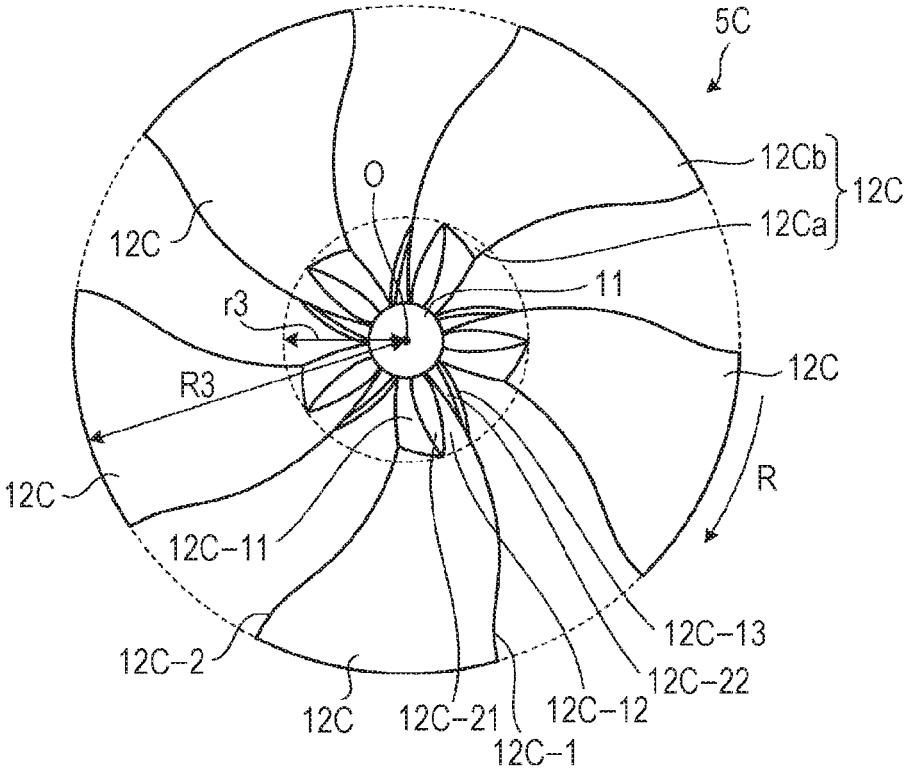
FIG. 6 is a plan view of the propeller fan according to the third embodiment as viewed from the positive pressure side.
Figure 7:
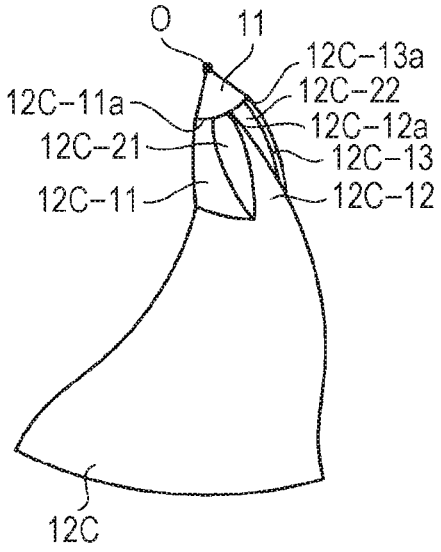
FIG. 7 is a plan view of one of blades of the propeller fan according to the third embodiment as viewed from the positive pressure side.
Figure 8:
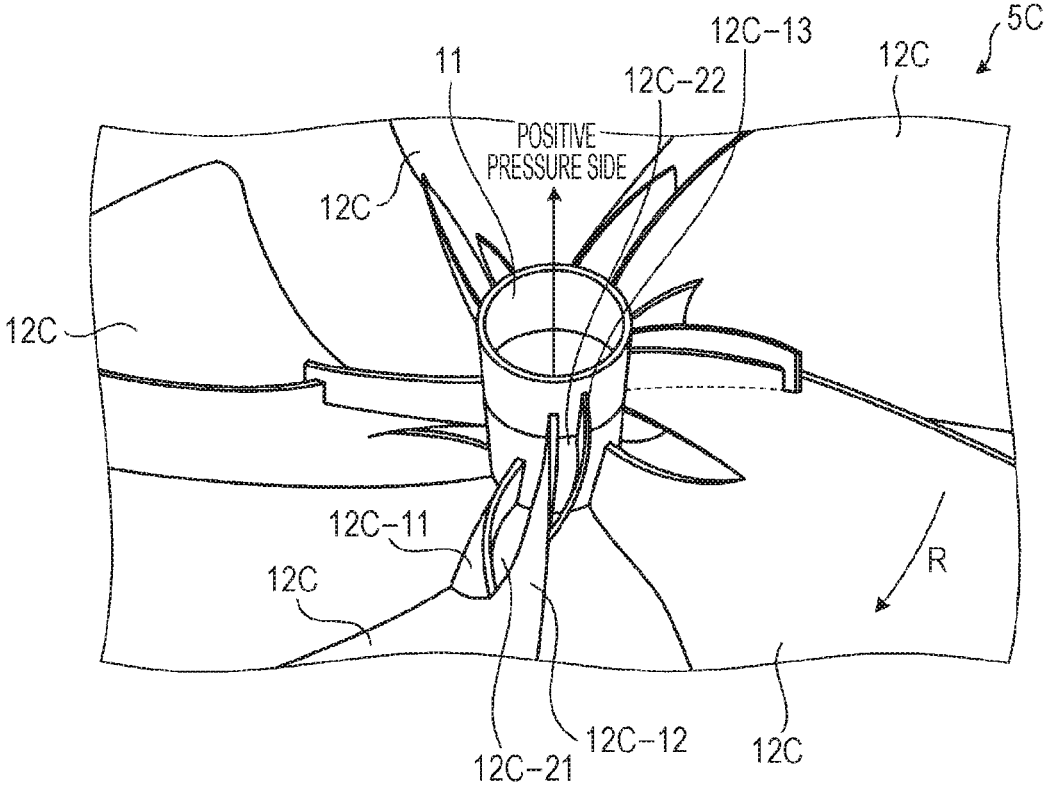
FIG. 8 is a perspective view of the periphery of bases of the blades of the propeller fan according to the third embodiment as viewed from the positive pressure side.
Figure 9:
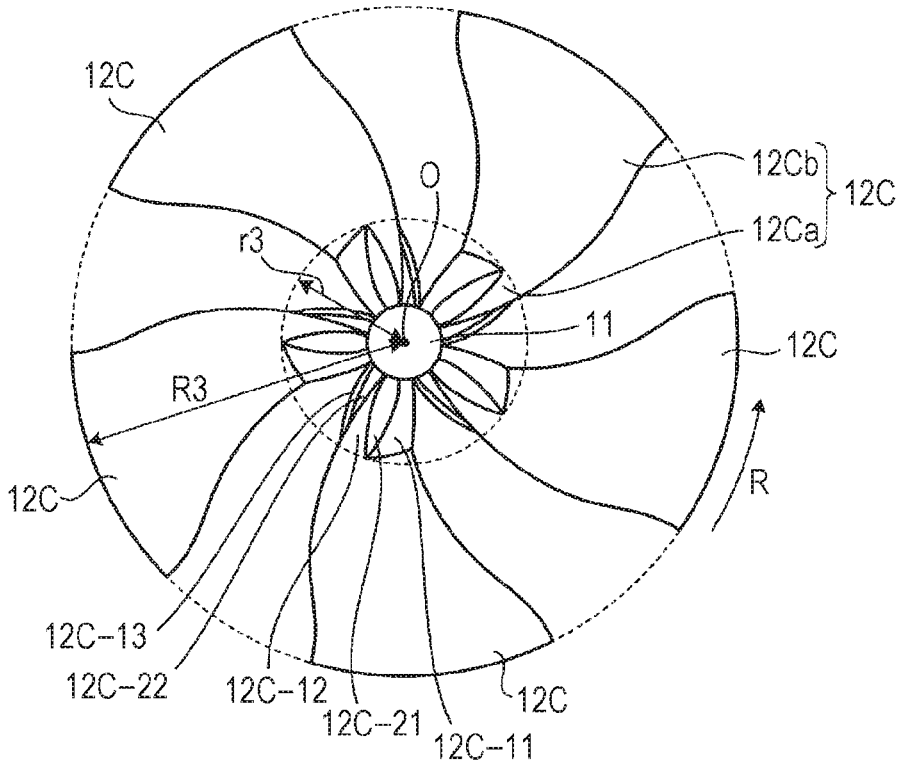
FIG. 9 is a plan view of the propeller fan according to the third embodiment as viewed from a negative pressure side.
Figure 10:
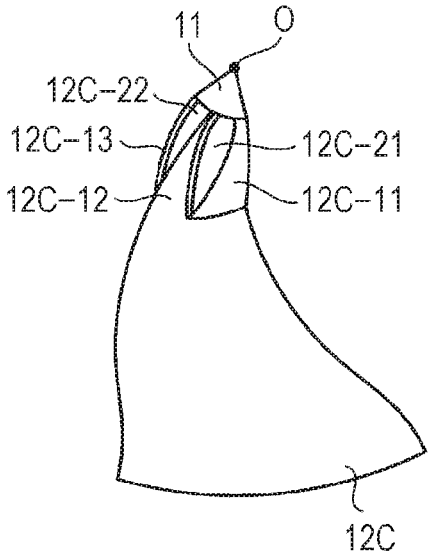
FIG. 10 is a perspective view of one of the blades of the propeller fan according to the third embodiment as viewed from the negative pressure side.

FIG. 6 is a plan view of a propeller fan according to a third embodiment as viewed from the positive pressure side. FIG. 7 is a plan view of one of blades of the propeller fan according to the third embodiment as viewed from the positive pressure side. FIG. 8 is a perspective view of the periphery of bases of the blades of the propeller fan according to the third embodiment as viewed from the positive pressure side. Moreover, FIG. 9 is a plan view of the propeller fan according to the third embodiment as viewed from the negative pressure side. FIG. 10 is a perspective view of one of the blades of the propeller fan according to the third embodiment as viewed from the negative pressure side.

Figure 11:
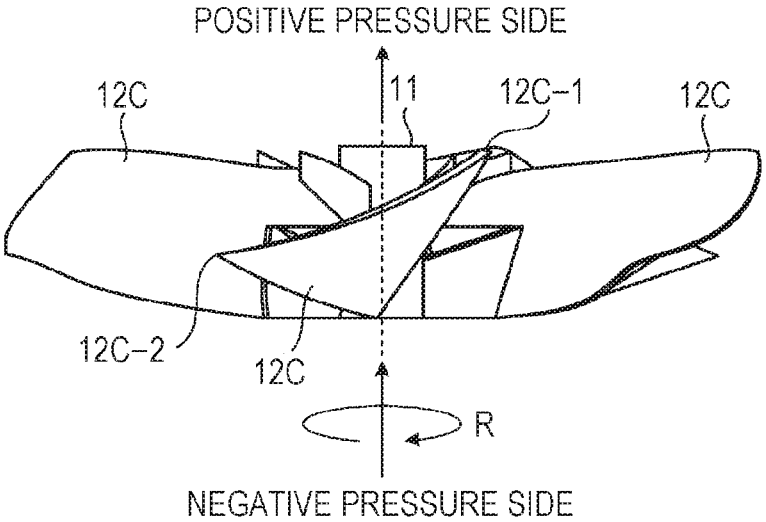
FIG. 11 is a side view of the propeller fan according to the third embodiment.
Figure 12:
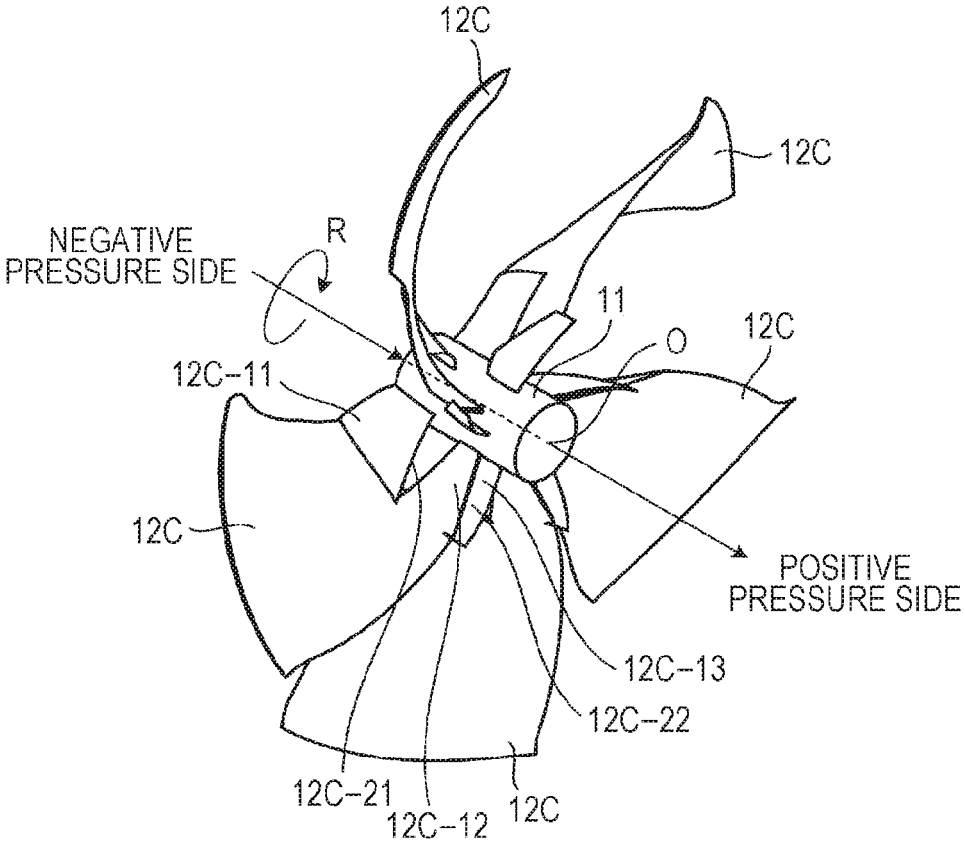
FIG. 12 is a perspective view of the propeller fan according to the third embodiment.
Figure 13:
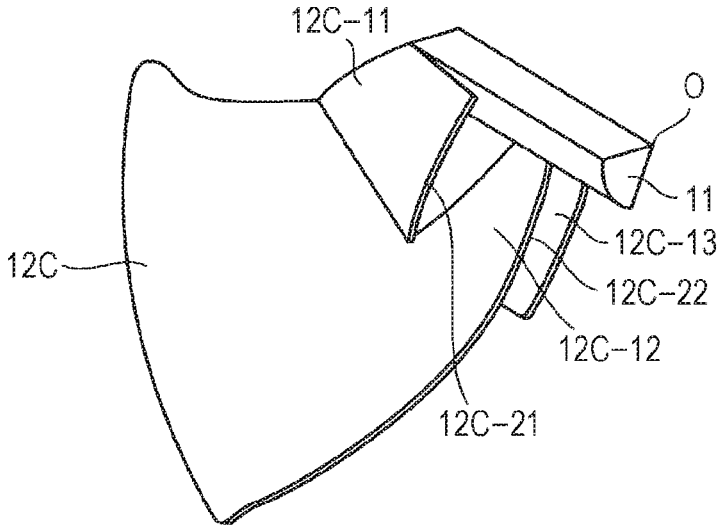
FIG. 13 is a perspective view of one of the blades of the propeller fan according to the third embodiment.
Figure 14:
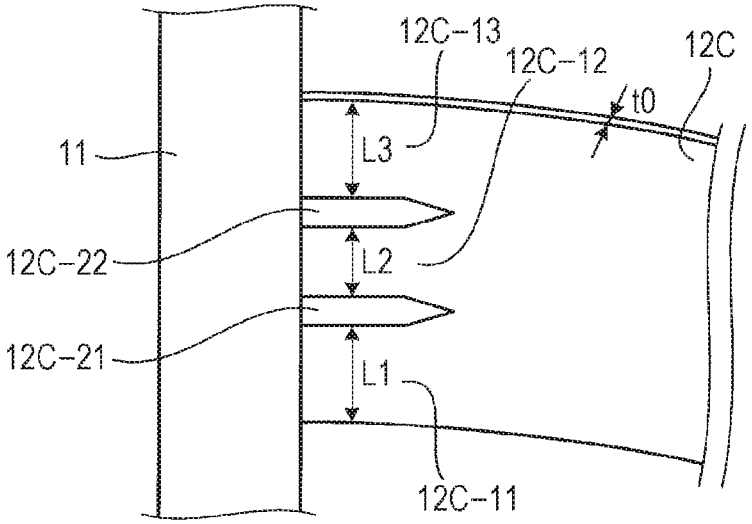
FIG. 14 schematically illustrates the chord length of each blade element and the total chord length of the blade elements.

Moreover, FIG. 11 is a side view of the propeller fan according to the third embodiment. FIG. 12 is a perspective view of the propeller fan according to the third embodiment. FIG. 13 is a perspective view of one of the blades of the propeller fan according to the third embodiment. FIG. 14 is a schematic view of the chord length of each blade element and the total chord length of the blade elements. Note that a propeller fan 5C according to the third embodiment is housed in an outdoor unit 1 illustrated in FIG. 1 as in the propeller fan 5A according to the first embodiment and the propeller fan 5B according to the second embodiment.

As illustrated in FIGS. 6 to 14, the propeller fan 5C according to the third embodiment has a circular columnar hub 11 and a plurality of blades 12C provided on a side surface of the hub 11. The hub 11 and the plurality of blades 12C are integrally molded using a molding material such as a resin material. The plurality of (five in an example of the third embodiment) blades 12C are formed integrally with the hub 11 at predetermined intervals along a circumferential direction of the hub 11 on the side surface 11*a* of the hub 11. Each blade 12C is formed in a plate shape.

In FIG. 6, the propeller fan 5C has, as viewed in plane, inner peripheral portions 12Ca and outer peripheral portions 12Cb of the blades 12C. The inner peripheral portions 12Ca are positioned within the circumference of a circle with a radius r3 about the center axis O. The outer peripheral portions 12Cb are positioned outside the circumference of the circle with the radius r3 about the center axis O and within the circumference of the circle of the propeller fan 5C with a radius R3. As illustrated in FIG. 6, the outer peripheral portion 12Cb extending in a radial direction of the hub 11 is formed with a blade area larger than that of the inner peripheral portion 12Ca coupled to the hub 11. In each blade 12C, a back edge portion 12C-1 on an upstream side in a rotation direction (the direction of "R" illustrated in FIG. 6) of the blade 12C is formed to curve toward a front edge portion 12C-2 positioned on the opposite side of the back edge portion 12C-1 (also see FIG. 11). The back edge portion 12C-1 curves as viewed from the direction of the center axis O as a rotation axis.

A surface (a blade surface) of each blade 12C is formed to gently curve from the negative pressure side to the positive pressure side of the propeller fan 5C while extending from the back edge portion 12C-1 to the front edge portion 12C-2 in the circumferential direction of the hub 11 (see, e.g., FIG. 9). When the propeller fan 5C provided with the above-described blades 12C rotates in the R-direction (the direction of "R" illustrated in FIG. 6), air flows from the negative pressure side to the positive pressure side. The volume of air flowing from the negative pressure side to the positive pressure side increases as the number of rotations of the propeller fan 5C increases.

A ratio r3/R3 (a radius ratio) between the radius r3 and the radius R3 as described herein satisfies Expression (4) below.

$$r3/R3 \leq 0.7 \quad (4)$$

For example, a radius ratio r3/R3 of 0.7 means that a boundary between the inner peripheral portion 12Ca and the outer peripheral portion 12Cb of the blade 12C as defined by the radius r3 from the center axis O is at a position with a length from the center axis O, the length being 0.7 times as long as the radius R3.

As illustrated in FIGS. 8 to 14, the propeller fan 5C has, in each inner peripheral portion 12Ca of the blades 12C, three blade elements 12C-11, 12C-12, 12C-13. Further, as specifically illustrated in FIG. 8, the propeller fan 5C has a hole 12C-21 between the blade element 12C-11 and the blade element 12C-12 in each inner peripheral portion 12Ca of the blades 12C, for example. In addition, the propeller fan 5C has a hole 12C-22 between the blade element 12C-12 and the blade element 12C-13 in each inner peripheral portion 12Ca of the blades 12C. That is, each blade 12C is connected to the hub 11 such that a base portion 12C-11*a* of the blade element 12C-11, a base portion 12C-12*a* of the blade element 12C-12, and a base portion 12C-13*a* of the blade element 12C-13 form the holes 12C-21, 12C-22 in the inner peripheral portion 12Ca. Each outer peripheral portion 12Cb is formed continuously from the blade elements 12C-11, 12C-12, 12C-13. The inner peripheral portion 12Ca and the outer peripheral portion 12Cb form a single blade surface. In the present embodiment, the base portion 12C-11*a*, the base portion 12C-12*a*, and the base portion 12C-13*a* are a base portion described in the CLAIMS. That is, the base portion 12C-11*a*, the base portion 12C-12*a*, and the base portion 12C-13*a* are portions of the blade 12C, the portions being connected to the hub 11.

In other words, the three blade elements 12C-11, 12C-12, 12C-13 are formed in such a manner that the blade 12C is branched from the outer peripheral portion 12Cb of the blade 12C while extending toward the inner peripheral portion 12Ca of the blade 12C. The hole 12C-21 between the blade element 12C-11 and the blade element 12C-12 and the hole 12C-22 between the blade element 12C-12 and the blade element 12C-13 serve as flow passages of an air current passing through the propeller fan 5C.

For example, as illustrated in FIGS. 7 and 8, the base portion 12C-13*a* of the blade element 12C-13 positioned on the most upstream side (the most back edge side) in the rotation direction (the direction of "R" in the figure) is, in each blade 12C, connected to the hub 11 on the positive pressure side in a center axis O direction as compared to the base portion 12C-12*a* of the blade element 12C-12 and the base portion 12C-11*a* of the blade element 12C-1 positioned on a downstream side (a front edge side). Moreover, the base portion 12C-12*a* of the blade element 12C-12 is connected on the positive pressure side in the center axis O direction of the hub 11 with respect to the base portion 12C-11*a* of the blade element 12C-11. Further, the hole 12C-21 of the blade 12C is positioned between the blade element 12C-12 and the blade element 12C-11 in the center axis O direction and the circumferential direction. The hole 12C-22 of the blade 12C is positioned between the blade element 12C-13 and the blade element 12C-12 in the center axis O direction and the circumferential direction.

When the total chord length of the inner peripheral portion 12Ca as the total of the chord lengths of the blade elements 12C-11 to 12C-13 is L0 [mm] and the minimum one of the chord lengths (the length of a straight line connecting one end and the other end of the blade element in a longitudinal direction of a section) of the blade elements 12C-11 to 12C-13 is Lmin [mm], Expression (5) below is satisfied.

$$L\ \min/L0 \geq 0.1 \quad (5)$$

Suppose that as illustrated in FIG. 14, the chord lengths of the blade elements 12C-11 to 12C-13 are each L1 [mm], L2 [mm], and L3 [mm] and a magnitude relationship of L1<L2<L3 is satisfied. In this case, Lmin=L1 and L0=L1+L2+L3 are satisfied, and L1/(L1+L2+L3)≥0.1 is satisfied from Expression (5) as described above.

FIGS. 6 to 14 illustrate such a form that the holes 12C-21, 12C-22 extend to the hub 11. However, when Expressions (4) to (6) as described above are satisfied, the shapes, forms, and the like of the holes 12C-21, 12C-22 are changeable as necessary. For example, a form can be employed, in which the holes 12C-21, 12C-22 reach positions apart from the hub 11 with predetermined distances.

As will be described later, in the third embodiment, as long as the propeller fan 5C satisfies conditions of the radius ratio r3/R3≤0.7 and Lmin/L0≥0.1, surging is less caused, and an air volume can be improved.

Note that the number of blade elements 12C-11 to 12C-13 and the number of holes 12C-21, 12C-22 in the blade 12C of the third embodiment are not limited to those illustrated in FIGS. 8 to 13. The blade 12C may have two blade elements and a single hole. Alternatively, the blade 12C may has four or more blade elements and three or more holes. That is, the outer peripheral portion 12Cb may be configured as a single blade surface, and the inner peripheral portion 12Ca may include at least one hole and a plurality of blade elements formed to sandwich the hole. The holes 12C-21, 12C-22 may be formed within an area from the boundary between inner peripheral portion 12Ca and the outer peripheral portion 12Cb to the side surface of the hub 11 in the radial direction. Alternatively, the holes 12C-21, 12C-22 may be formed in abutting contact with both of the above-described boundary and the side surface of the hub 11.

(Relationship of Radius Ratio with Air Volume and Efficiency and Relationship of Blade Element Minimum/Total Chord Length with Air Volume and Efficiency)

Figure 15:
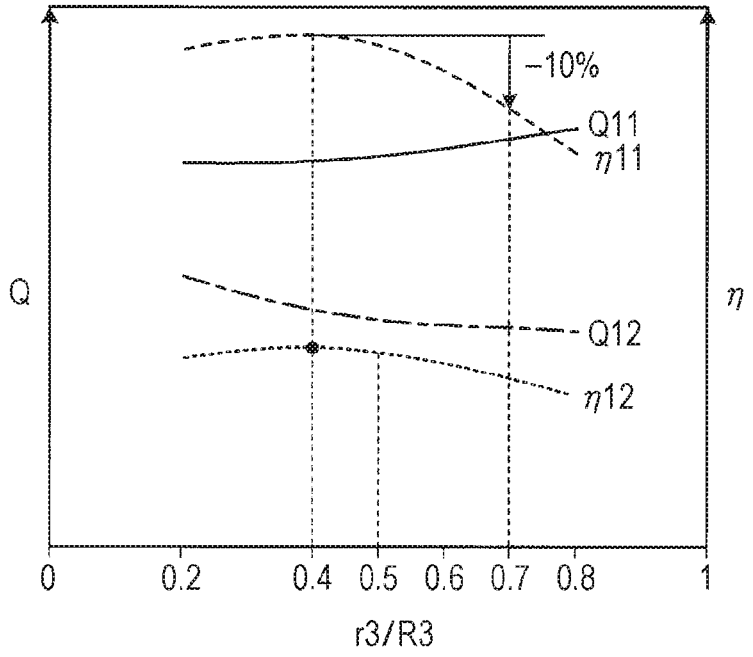
FIG. 15 illustrates graphs of a relationship of a radius ratio with an air volume and an efficiency.
Figure 16:
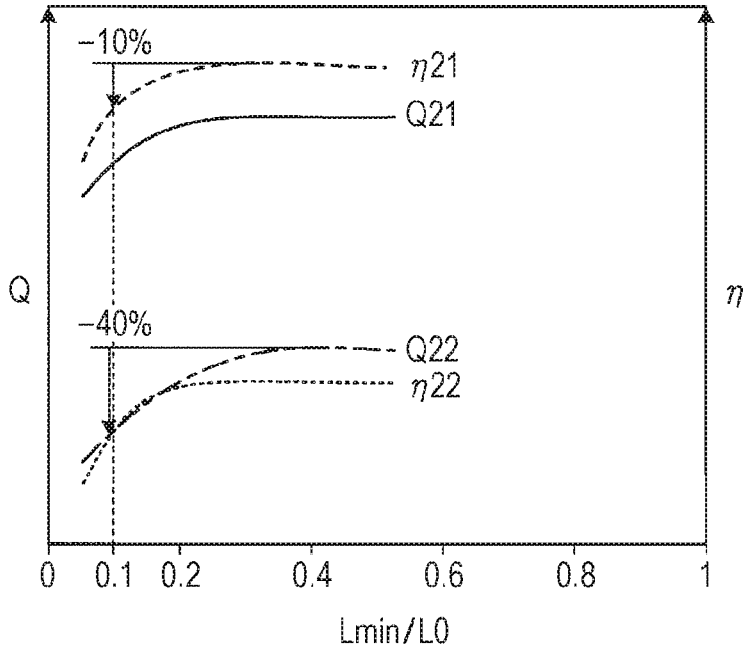
FIG. 16 illustrates graphs of a relationship of a blade element minimum/total chord length with the air volume and the efficiency.

FIG. 15 illustrates graphs (curves) of a relationship of the radius ratio with the air volume and an efficiency. FIG. 16 illustrates graphs (curves) of a relationship of the blade element minimum/total chord length with the air volume and the efficiency. FIG. 15 shows the basis of a radius ratio of equal to or lower than 0.7 in the third embodiment. Moreover, FIG. 16 shows the basis of a blade element minimum/total chord length of equal to or longer than 0.1 in the third embodiment.

In FIG. 15, the radius ratio is the horizontal axis, and the air volume Q [$m^3$/h] and the efficiency η(=the air volume Q/an input) [$m^3$/h/W] are the vertical axes. In FIG. 15, the air volume Q11 and the efficiency η11 correspond to an air volume and an efficiency when the propeller fan 5C rotates with a rated load of an air conditioner. On the other hand, the air volume Q12 and the efficiency η12 correspond to an air volume and an efficiency when the propeller fan 5C rotates with a higher load than the rated load of the air conditioner. In any of the rated load state and the high load state, it is preferable that the efficiencies η11, η12 do not extremely decrease from peak values.

In FIG. 15, the efficiencies η11, η12 show the peak values thereof at the radius ratio r3/R3≤0.4 to 0.5. Thus, in the rated load state, when the radius ratio r3/R3≤0.7 is satisfied, the efficiency η11 of the propeller fan 5C falls within a range from the peak value to equal to or smaller than about −10% of the peak value. Moreover, in the high load state, when the radius ratio r3/R3≤0.5 is satisfied, the air volume Q12 and the efficiency η12 of the propeller fan 5C are maximum.

In FIG. 16, the minimum cord length of the base portion of the blade element/the blade element total chord length (=Lmin/L0) is the horizontal axis, and the air volume Q [$m^3$/h] and the efficiency η[$m^3$/h/W] are the vertical axes. In FIG. 16, the air volume Q21 and the efficiency η21 correspond to an air volume and an efficiency when the propeller fan 5C rotates with the rated load of the air conditioner. On the other hand, the air volume Q22 and the efficiency η22 correspond to an air volume and an efficiency when the propeller fan 5C rotates with the higher load than the rated load of the air conditioner.

Regarding the efficiency η21 in the rated load state, the amount of decrease in the efficiency η21 in the rated load state is a small value of 10% of the peak value across the entire range of the blade element minimum/total chord length (=Lmin/L0) as illustrated in FIG. 16. Thus, there is no specific limitation on the blade element minimum/total chord length (=Lmin/L0). On the other hand, in the high load state, the rate of decrease in the air volume Q21 is equal to or higher than 40% of the peak value in the case of the blade element minimum/total chord length (=Lmin/L0)<0.1 as illustrated in FIG. 16. For this reason, the blade element minimum/total chord length (=Lmin/L0)≥0.1 is set.

Thus, according to the above-described first to third embodiments, the air velocity at the inner peripheral portion 12Aa, 12Ba, 12Ca is improved regardless of improvement of the air velocity at the outer peripheral portion 12Ab, 12Bb, 12Cb of the blade 12A, 12B, 12C. Consequently, the difference (the air velocity difference) between the air velocity at the outer peripheral portion 12Ab, 12Bb. 12Cb and the air velocity at the inner peripheral portion 12Aa, 12Ba, 12Ca can be reduced. With this configuration, air turbulence at the inner peripheral portion 12Aa, 12Ba, 12Ca due to the air velocity difference and an abnormal operation state such as the surging phenomenon due to stalling of an air current can be reduced. As a result, the volume of air which can be generated by rotation of the propeller fan 5A, 5B, 5C can be increased.

The embodiments have been described above. Note that the above-described contents are not intended to limit the technique disclosed in the present application. Moreover, the above-described components include those easily arrived by those skilled in the art, those substantially identical to the above-described components, and those within a so-called equivalent scope. Further, the above-described components can be combined as necessary. In addition, at least one of various omissions, replacements, and changes of the components can be made without departing from the gist of the embodiments.

Note that a radius ratio r1/R1 of 0.4 may mean that the boundary between the inner peripheral portion 12Aa and the outer peripheral portion 12Ab is, in the blade 12A, at such a position that the radius r1 from the center axis O is 0.4 times as long as the radius R1, taking the radius R1 from the center axis O as 1. A radius ratio r3/R3 of 0.7 may mean that the boundary between the inner peripheral portion 12Ca and the outer peripheral portion 12Cb is, in the blade 12C, at such a position that the radius r3 from the center axis O is 0.7 times as long as the radius R3, taking the radius R3 from the center axis O as 1.

The embodiments of the present disclosure may be the following first to sixth propeller fans.

The first propeller fan includes a hub having a side surface about a center axis, and a plurality of blades provided on the side surface of the hub. Each blade includes, in a portion from a base portion connected to the hub to an outer edge, an inner peripheral portion positioned on a base portion side, and an outer peripheral portion positioned on an outer edge side. A ratio r/R between a radius r as a distance from the center axis to a boundary between the inner peripheral portion and the outer peripheral portion and a radius R as a distance from the center axis to the outer edge is equal to or lower than 0.4. A relational expression of $V1<V2\times1.3$ is satisfied, where an air velocity at the outer peripheral portion is V1 and an air velocity at the inner peripheral portion is V2.

The second propeller fan is the first propeller fan in which the outer peripheral portion is formed as a single blade surface and the inner peripheral portion includes a plurality of blade elements disposed at predetermined intervals.

The third propeller fan includes a hub having a side surface about a center axis, and a plurality of blades provided on the side surface of the hub. Each blade includes, in a portion from a base portion connected to the hub to an outer edge, an inner peripheral portion positioned on a base side, and an outer peripheral portion positioned on an outer edge side. The outer peripheral portion is formed as a single blade surface. The inner peripheral portion includes at least one hole and a plurality of blade elements formed to sandwich the hole. The hole is provided in abutting contact with a boundary between the inner peripheral portion and the outer peripheral portion in a radial direction. A ratio r/R between a radius r as a distance from the center axis to the boundary between the inner peripheral portion and the outer peripheral portion and a radius R as a distance from the center axis to the outer edge is equal to or lower than 0.7. A relational expression of $Lmin/L0\geq0.1$ mm is satisfied, where the total of the chord lengths of the plurality of blade elements is L0 [mm] and the minimum one of the chord lengths of the plurality of blade elements is Lmin [mm].

The fourth propeller fan is the third propeller fan in which the hole is formed from the boundary between the inner peripheral portion and the outer peripheral portion to the side surface of the hub in the radial direction.

The fifth propeller fan is the third or fourth propeller fan in which a back-edge-side blade element of the plurality of blade elements is, in each blade, connected to the hub on a positive pressure side of the each blade as compared to a front-edge-side blade element of the plurality of blade elements.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A propeller fan comprising:

a hub having a side surface about a center axis; and a plurality of blades provided on the side surface of the hub, wherein each blade includes an inner peripheral portion positioned closer to a base portion of the blade connected to the hub, and an outer peripheral portion positioned closer to an outer edge of the blade, wherein the inner peripheral portion and the outer peripheral portion keep an air velocity ratio between an air velocity at the outer peripheral portion and an air velocity at the inner peripheral portion at a predetermined value, and improve volume of air from the propeller fan, wherein the predetermined value is set to reduce occurrence of a surging region regardless of a blade shape, wherein each blade improves the air velocity at the inner peripheral portion regardless of improvement of the air velocity at the outer peripheral portion of the blade to reduce a difference between the air velocity at the outer peripheral portion and the air velocity at the inner peripheral portion, wherein the outer peripheral portion is formed as a single blade surface, wherein the inner peripheral portion includes a plurality of blade elements disposed at a predetermined interval such that base portions of each of a pair of the blade elements form a hole in the inner peripheral portion, wherein the hole is positioned between the pair of the blade elements in a center axis direction and a circumferential direction of the hub, wherein the propeller fan satisfies conditions of a radius ratio between the inner peripheral portion and the outer peripheral portion $(r3/R3)\leq0.7$ and a blade element minimum/total chord length $(Lmin/L0)\geq0.1$, wherein the pair of the blade elements of each blade are formed in such a manner that the blade is branched from the outer peripheral portion of the blade while extending toward the inner peripheral portion of the blade, and the hole between the pair of the blade elements serves as a flow passage of an air current passing through the propeller fan, wherein a chord length, which is a length of a straight line connecting one end and another end of each of the blade elements in a longitudinal direction of a section, is adjusted so that the air velocity ratio as a ratio of the air velocity at the outer peripheral portion to the air velocity at the inner peripheral portion is the predetermined value, wherein the blade elements include a first blade element and a second blade element, wherein the first blade element and the second blade element are respectively positioned on a downstream side and an upstream side in a rotation direction with respect to the hub, and wherein a first height on a most positive pressure side in the center axis direction, in a portion connecting the first blade element and the side surface of the hub is positioned between a second height on a most negative pressure side in the center axis direction, in a portion connecting the second blade element and the side surface of the hub and a third height on a most positive pressure side in the center axis direction, in the portion connecting the second blade element and the side surface of the hub.

2. A propeller fan comprising:

a hub having a side surface about a center axis; and a plurality of blades provided on the side surface of the hub, wherein each blade includes an inner peripheral portion positioned closer to a base portion of the blade connected to the hub, and an outer peripheral portion positioned closer to an outer edge of the blade, wherein the outer peripheral portion is formed as a single blade surface, wherein the inner peripheral portion includes at least one hole, and a plurality of blade elements formed to sandwich the hole, wherein the hole is provided in abutting contact with a boundary between the inner peripheral portion and the outer peripheral portion in a radial direction, wherein a ratio r/R between a radius r as a distance from the center axis to the boundary between the inner peripheral portion and the outer peripheral portion and a radius R as a distance from the center axis to the outer edge of each blade is equal to or lower than 0.7, wherein a relational expression of $Lmin/L0 \geq 0.1$ is satisfied, where a total of chord lengths of the plurality of blade elements is L0 [mm] and a minimum one of the chord lengths of the plurality of blade elements is Lmin [mm], wherein each blade improves an air velocity at the inner peripheral portion regardless of improvement of an air velocity at the outer peripheral portion of the blade to reduce a difference between the air velocity at the outer peripheral portion and the air velocity at the inner peripheral portion, wherein the hole is formed within an area from the boundary between the inner peripheral portion and the outer peripheral portion to the side surface of the hub in the radial direction, wherein the hole is positioned between each of pairs among the blade elements in a center axis direction and a circumferential direction of the hub, wherein the each of pairs among the blade elements is formed in such a manner that the blade is branched from the outer peripheral portion of the blade while extending toward the inner peripheral portion of the blade, and the hole between the each of pairs among the blade elements serves as a flow passage of an air current passing through the propeller fan, wherein a chord length, which is a length of a straight line connecting one end and another end of each of the blade elements in a longitudinal direction of a section, is adjusted so that an air velocity ratio as a ratio of the air velocity at the outer peripheral portion to the air velocity at the inner peripheral portion is a predetermined value, wherein the blade elements include a first blade element and a second blade element, wherein the first blade element and the second blade element are respectively positioned on a downstream side and an upstream side in a rotation direction with respect to the hub, and wherein a first height on a most positive pressure side in the center axis direction, in a portion connecting the first blade element and the side surface of the hub is positioned between a second height on a most negative pressure side in the center axis direction, in a portion connecting the second blade element and the side surface of the hub and a third height on a most positive pressure side in the center axis direction, in the portion connecting the second blade element and the side surface of the hub.

3. The propeller fan according to claim 2, wherein in each blade, a trailing-edge-side blade element of the plurality of blade elements is positioned more axially-downstream than a leading-edge side blade element of the plurality of blade elements.

* * * * *